US009661413B2

(12) United States Patent
Quinn et al.

(10) Patent No.: US 9,661,413 B2
(45) Date of Patent: May 23, 2017

(54) ACOUSTIC LAYER IN MEDIA DEVICE PROVIDING ENHANCED AUDIO PERFORMANCE

(71) Applicant: Avnera Corporation, Beaverton, OR (US)

(72) Inventors: Patrick A. Quinn, Aloha, OR (US); Robert C. Proebstel, Beaverton, OR (US); Manpreet S. Khaira, Portland, OR (US); Thomas Irrgang, Portland, OR (US); Nigel D. Waites, Lakeville, MN (US); Ian J Myles, Singapore (SG)

(73) Assignee: AVNERA CORPORATION, Beaverton, OR (US)

( * ) Notice: Subject to any disclaimer, the term of this patent is extended or adjusted under 35 U.S.C. 154(b) by 290 days.

(21) Appl. No.: 14/231,664

(22) Filed: Mar. 31, 2014

(65) Prior Publication Data

US 2014/0219490 A1 Aug. 7, 2014

Related U.S. Application Data

(63) Continuation-in-part of application No. PCT/US2012/069692, filed on Dec. 14, 2012, and a (Continued)

(51) Int. Cl.
*H04R 5/02* (2006.01)
*H04R 29/00* (2006.01)

(Continued)

(52) U.S. Cl.
CPC ..... *H04R 1/32* (2013.01); *H04R 1/2803* (2013.01); *H04R 3/005* (2013.01); *H04R 1/026* (2013.01);

(Continued)

(58) Field of Classification Search
CPC ..... H04R 1/26; H04R 1/2811; H04R 1/2819; H04R 1/2834; H04R 1/2857; H04R 1/2888; H04R 1/345; H04R 1/2803

(Continued)

(56) References Cited

U.S. PATENT DOCUMENTS 5,668,882 A 9/1997 Hickman
8,103,035 B2 1/2012 Parker (Continued)

FOREIGN PATENT DOCUMENTS

FR 2770352 A1 4/1999
WO 2004/066673 A1 8/2004

(Continued)

OTHER PUBLICATIONS

Extended European Search Report, Dec. 14, 2015, 11 pages, EP Application No. 12866362.2, European Patent Office, Munich, Germany.

(Continued)

*Primary Examiner* — George Monikang
(74) *Attorney, Agent, or Firm* — Marger Johnson

(57) ABSTRACT

An acoustic layer is added to a laptop-type personal computing device, comprising: enclosing walls, optionally—one or more microphones, a signal processing device, at least one audio transducer, and an acoustic waveguide. The acoustic layer adjoins one or more internal areas of a laptop-type device. The signal processing device receives an internal signal from a laptop-type device. The signal processing device provides a directive sound enhancement of the audio input signals based on room acoustics, such as reverberation, echo, noise, delay, frequency response, and/or speaker-positional information that is determined by the signal processing device. The audio transducer device generates an audible audio output in response to an audio signal (Continued)

output from the signal processing device. The acoustic waveguide receives the audible audio output and generates an enhanced bass audio output from the acoustic waveguide.

24 Claims, 12 Drawing Sheets

Related U.S. Application Data continuation-in-part of application No. 13/419,222, filed on Mar. 13, 2012.

(60) Provisional application No. 61/806,786, filed on Mar. 29, 2013, provisional application No. 61/576,863, filed on Dec. 16, 2011.

(51) Int. Cl.

| | |
|---|---|
| ***H04R 1/32*** | (2006.01) |
| ***H04R 1/28*** | (2006.01) |
| ***H04R 3/00*** | (2006.01) |
| *H04R 1/02* | (2006.01) |

(52) U.S. Cl.
CPC ..... *H04R 29/00* (2013.01); *H04R 2225/33* (2013.01); *H04R 2400/03* (2013.01); *H04R 2420/07* (2013.01)

(58) Field of Classification Search
USPC ..... 381/58, 59, 334, 332, 333
See application file for complete search history.

(56) References Cited

U.S. PATENT DOCUMENTS

| | | | | |
|---|---|---|---|---|
| 2005/0100182 | A1* | 5/2005 | Sykes | G09B 21/009 381/315 |
| 2006/0165241 | A1 | 7/2006 | Reid | |
| 2007/0217633 | A1 | 9/2007 | Copeland et al. | |
| 2007/0268116 | A1* | 11/2007 | Khoury | G06F 3/016 340/407.1 |
| 2008/0152181 | A1 | 6/2008 | Parker et al. | |
| 2010/0093401 | A1 | 4/2010 | Moran et al. | |
| 2010/0188212 | A1 | 7/2010 | Jochelson | |
| 2011/0058677 | A1* | 3/2011 | Choi | H04R 5/04 381/17 |
| 2011/0127970 | A1* | 6/2011 | Wang | H02J 7/0091 320/150 |
| 2011/0150259 | A1 | 6/2011 | Parker | |
| 2011/0255702 | A1 | 10/2011 | Jensen | |
| 2012/0039475 | A1* | 2/2012 | Berardi | H04R 3/12 381/17 |
| 2012/0068832 | A1 | 3/2012 | Feldstein | |
| 2012/0128165 | A1* | 5/2012 | Visser | G10L 19/008 381/56 |
| 2012/0162058 | A1 | 6/2012 | Davis | |
| 2013/0058495 | A1* | 3/2013 | Furst | H04R 3/00 381/80 |

FOREIGN PATENT DOCUMENTS

| | | | |
|---|---|---|---|
| WO | 2008/117908 | A1 | 10/2008 |
| WO | 2011/139502 | A1 | 11/2011 |

OTHER PUBLICATIONS

International Search Report, Jan. 15, 2015, 5 pages, International Application No. PCT/US2012/069692, Korean Intellectual Property Office, Republic of Korea.

Written Opinion of the International Searching Authority, Jan. 15, 2015, 8 pages, International Application No. PCT/US2012/069692, Korean Intellectual Property Office, Republic of Korea.

* cited by examiner 100
101
107
106

100
107
106

108
101
112
102
103b
104
106
115
103a
100
113
108

100
106
101
107

101
107
106
100

ACOUSTIC LAYER IN MEDIA DEVICE PROVIDING ENHANCED AUDIO PERFORMANCE

RELATED APPLICATIONS

This application is a continuation-in-part of and claims the benefit of priority to co-pending Patent Cooperation Treaty application number PCT/US2012/069692, filed Dec. 14, 2012 by Avnera Corporation, which in turn claims priority to U.S. Provisional Patent Application Ser. No. 61/576,863, filed Dec. 16, 2011; and this application is also a continuation-in-part of and claims the benefit of priority to U.S. Non-Provisional patent application Ser. No. 13/419,222, filed Mar. 13, 2012, which in turn also claims priority to U.S. Provisional Patent Application Ser. No. 61/576,863; and this application also claims priority to U.S. Provisional Patent Application Ser. No. 61/806,786 filed Mar. 29, 2013; the entire contents of each of which are expressly incorporated in this application by this reference.

FIELD OF THE INVENTION

The subject matter disclosed herein relates to personal electronic multi-media devices. More particularly, the subject matter disclosed herein relates to the addition of a physical and technological layer to the design of a laptop-type computer, netbook computer, ultrabook computer, or tablet-like computer (hereafter, each being referred to as a "laptop-type computer" for descriptive convenience) that provides enhanced audio output. This added layer will hereafter be referred to as an "acoustic layer."

BACKGROUND OF THE INVENTION

As personal electronic devices become smaller and provide more multi-media entertainment features and capabilities, one of the disadvantages that accompanies the trend toward the smaller size is that the audio speakers contained in such a compact laptop-type computer also tend to be smaller, thereby providing a less than satisfactory audio experience. Also, there has been inadequate attention to the design of an intentional audio space as part of the design of the product's audio output.

DETAILED DESCRIPTION OF THE PREFERRED EMBODIMENTS

Figures 1A, 1B, 1C, 1D, 1E:
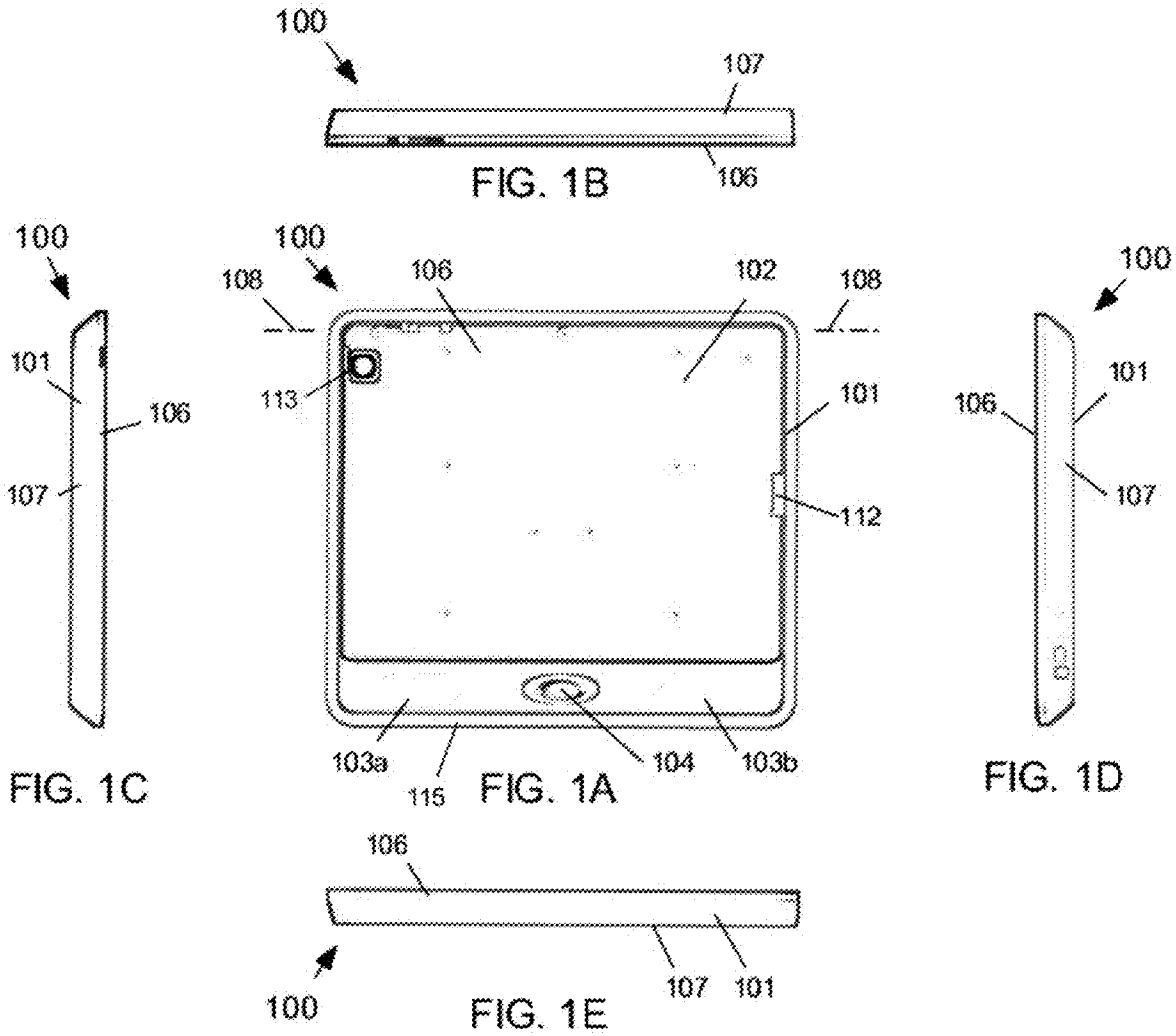
FIGS. 1A-1G respectively depict top, back, left-side, right-side, front, bottom and top perspective views of an exemplary embodiment of an acoustic layer (not shown) according to the subject matter disclosed herein.
Figure 1G:
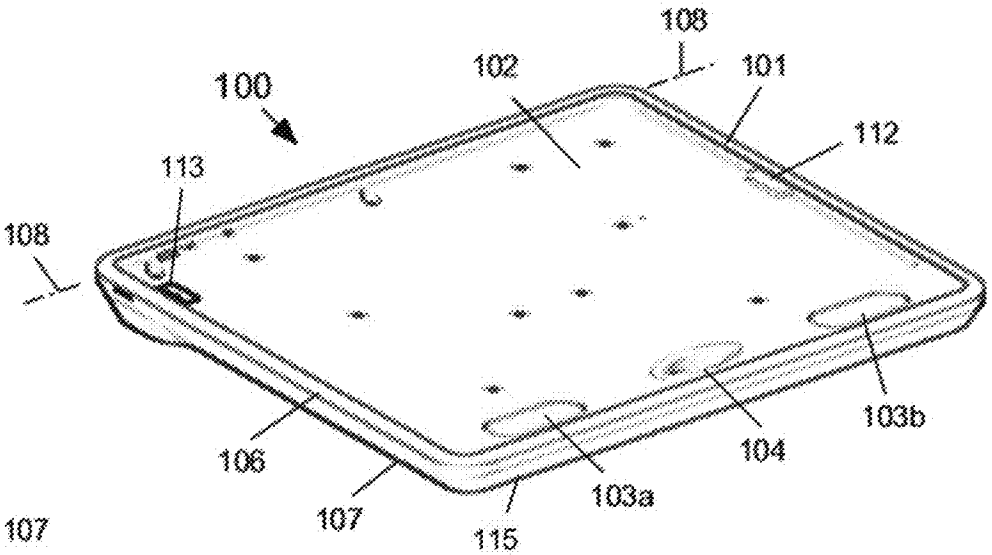
Figure 1F:
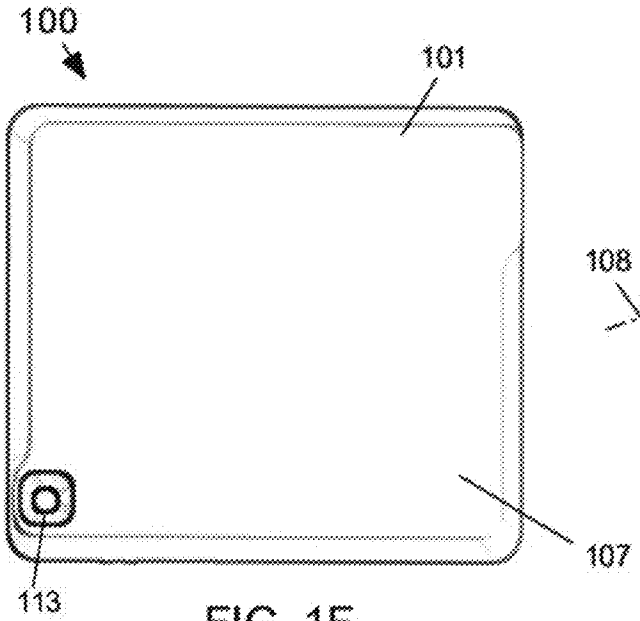

The subject matter disclosed herein is illustrated by way of example and not by limitation in the accompanying figures in which like reference numerals indicate similar elements.

As used throughout this application, the word "exemplary" means "serving as an example, instance, or illustration." Any embodiment described herein as "exemplary" is not to be construed as necessarily preferred or advantageous over other embodiments. Additionally, for simplicity and/or clarity of illustration, elements illustrated in the figures have not necessarily been drawn to scale. For example, the dimensions of some of the elements may be exaggerated relative to other elements for illustrative clarity. Further, in some figures only one or two of a plurality of similar elements are indicated by reference characters for illustrative clarity of the figure, whereas all of the similar element may not be indicated by reference characters. Further still, it should be understood that although some portions of components and/or elements of the subject matter disclosed herein have been omitted from the figures for illustrative clarity, good engineering, construction and assembly practices are intended.

The terms "pad," "electronic pad-type device," "pad-type device," "tablet," "tablet-type device," "multi-media computing device," "smartphone," "smartphone-type device," "personal multi-media electronic tablet," "personal multi-media electronic device," and "electronic pad device" are intended to be interchangeable terms throughout this application, and are intended to refer to similar type devices. Exemplary pad-type devices include, but are not limited to, pad-type computing devices (e.g., those sold under the APPLE Corporation trademark 'IPAD,' etc.), mobile phone devices (e.g., those sold under the APPLE Corporation trademark 'IPHONE,' etc.), a media player, a handheld-computing device, or a handheld multimedia device, numerous variations of any of which device types are available from alternate manufacturers, and in various sizes, as an ordinarily skilled artisan will readily recognize.

FIGS. 1A-1G respectively depict top, back, left-side, right-side, front, bottom and top perspective views of an exemplary embodiment of an audio performance-enhancing device 100 for a pad-type device (not shown) according to the subject matter disclosed in U.S. patent application Ser. No. 13/419,222 and in PCT application PCT/US12/69692, the entire disclosures of which are expressly incorporated herein by this reference. Solely for descriptive convenience, this specification alternately but equivalently refers to the audio performance-enhancing device 100 as an "acoustic layer" or an "acoustic layer device."

The acoustic layer device 100 provides a robust stereo audio output with enhanced-bass for a pad-type device, while also providing a protective cover for the pad-type device. In particular, the acoustic layer device 100 comprises a case or housing 101 that is adapted to receive a pad-type device (not shown) in a recessed-well region 102 that is formed on the top side of acoustic layer 100, and best shown in FIG. 1G. The shape of recessed-well region 102 can be specifically configured for any particular pad-type device, according to the conceived embodiments. In an exemplary embodiment, the acoustic layer device is configured so that a pad-type device can slide into and be captively held by the acoustic layer, or can be placed within the acoustic layer with a hinged portion of the acoustic layer closing over and captively holding the pad-type device.

Figure 2A:
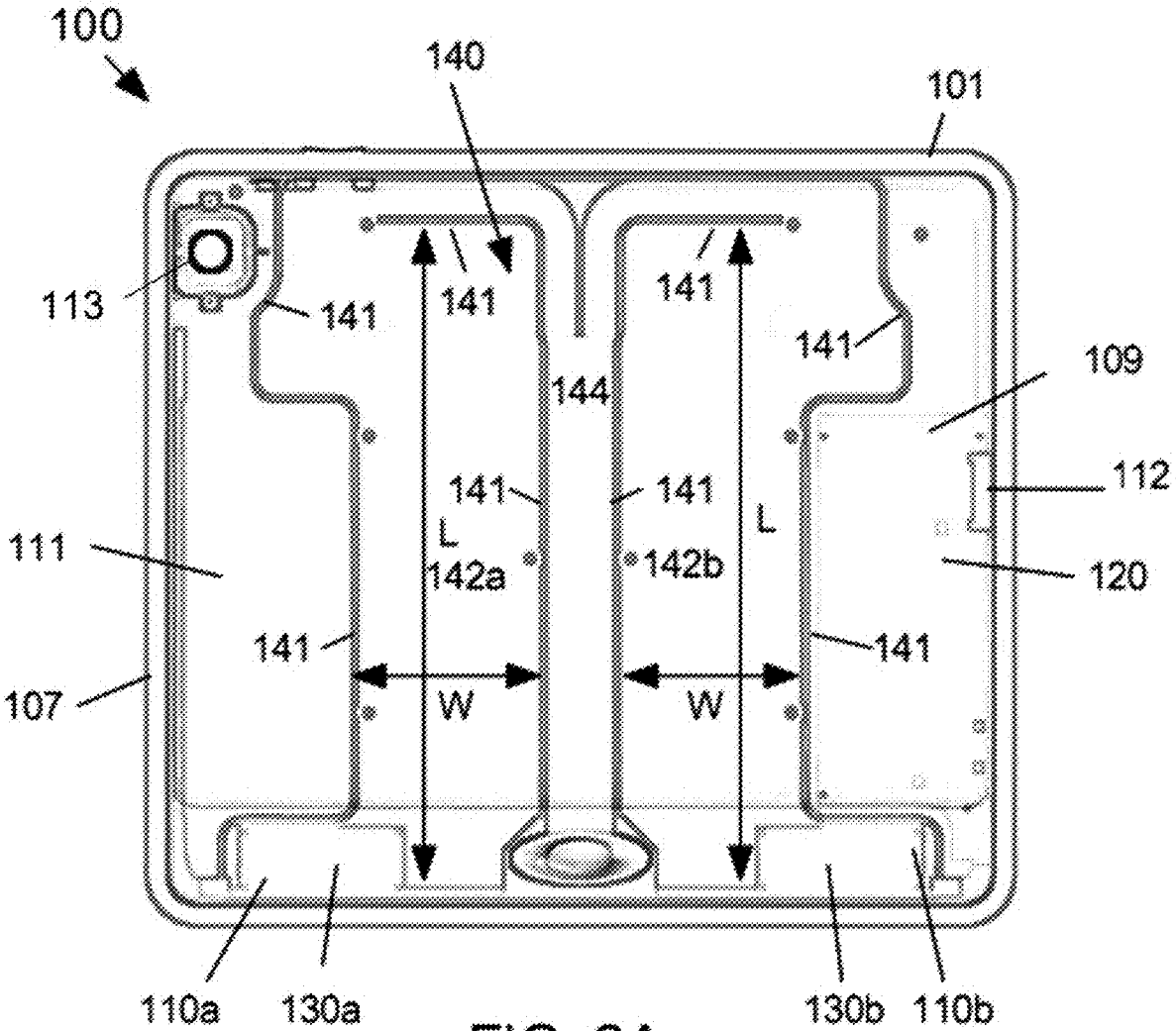
FIGS. 2A and 2B respectively depict an internal top view and an internal top perspective view of the exemplary embodiment of the acoustic layer depicted in FIGS. 1A-1G according to the subject matter disclosed herein.
Figure 2B:
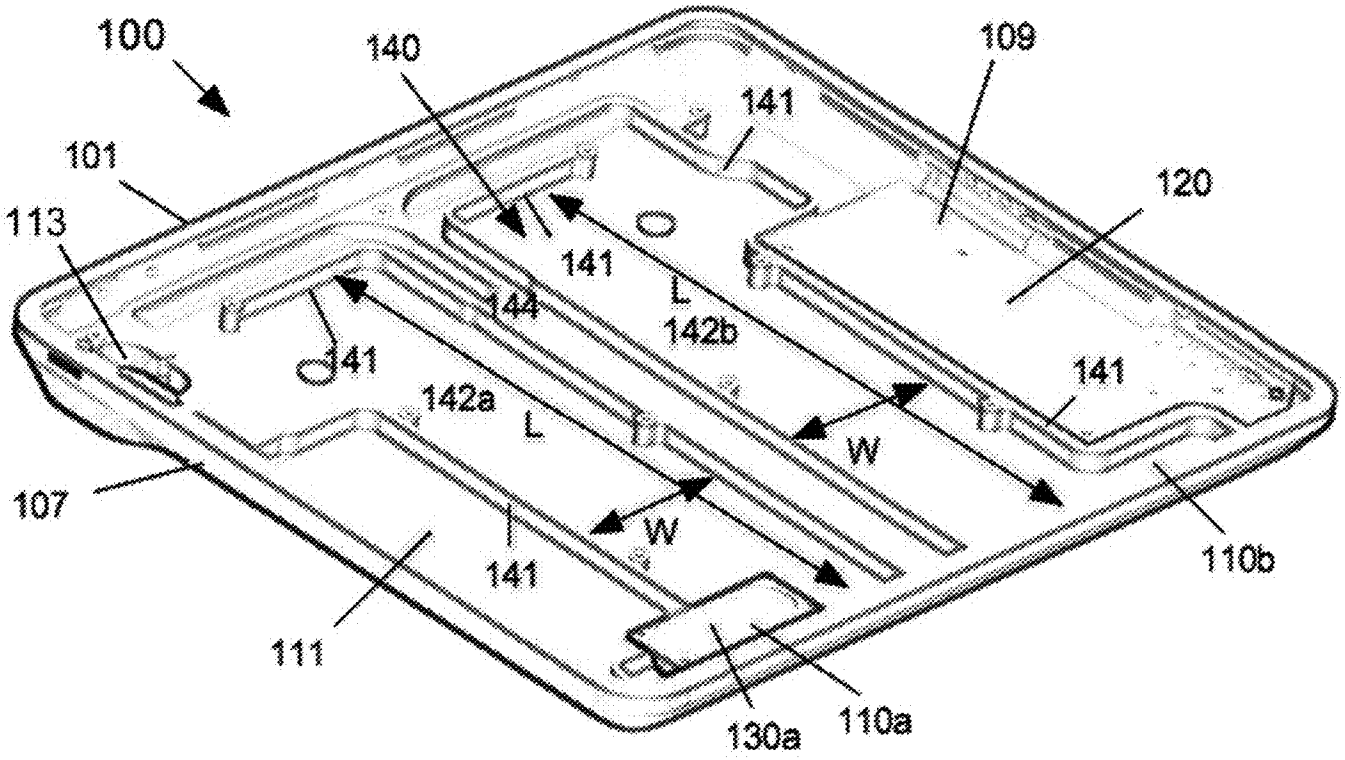

Exemplary case 101 encloses an audio processing device, such as an audio amplifier with functional controls, two audio transducers (i.e., speakers), an audio enhancement acoustic waveguide structure, and a power source. The audio processor device drives the audio transducers in a well-known manner to generate an audio output that is projected from the front side of the audio transducers and through apertures 103*a*, 103*b*. According to the subject matter disclosed herein, the audio output that is generated from the back side of each transducer is channeled through an acoustic waveguide structure, as shown in FIGS. 2A-2B for example, that is adapted to enhance the bass response of the audio transducers. The output of the acoustic waveguide structure is through a bass output aperture 104. The acoustic waveguide structure provides a richer, fuller-sounding audio output in comparison to the audio output from only the front side of the audio transducers.

In an exemplary embodiment, case 101 is formed by a top cover 106 and a bottom cover 107. Top cover 106 is releasably hinged to bottom cover 107 along an axis 108 so that top cover 196 and bottom cover 107 open and close in a clam-shell manner along axis 108, thereby making the internal components of the acoustic layer accessible. The hinging (not shown) is releasable so that top cover 106 can be conveniently separated from bottom cover 107. In another exemplary embodiment, top cover 106 comprises an integral protective screen cover (not shown) that protects a pad-type device when the pad-type device is received into recessed-well region 102. In one exemplary embodiment, the protective screen cover provides a see-through window that permits the display of the pad-type device to be seen and provides openings through which the audio output from the acoustic layer device can pass. In one exemplary embodiment, the protective screen cover provides an opaque cover to the pad-type device and/or openings through which the audio output from the acoustic layer device can pass. In another exemplary embodiment, the integral protective screen cover is hinged at or near axis 108 and can be rotated from a closed position and positioned at a selected angle with respect to the bottom of the acoustic layer device, thereby permitting a user to view the pad-type device at a selected angle.

Figure 4B:
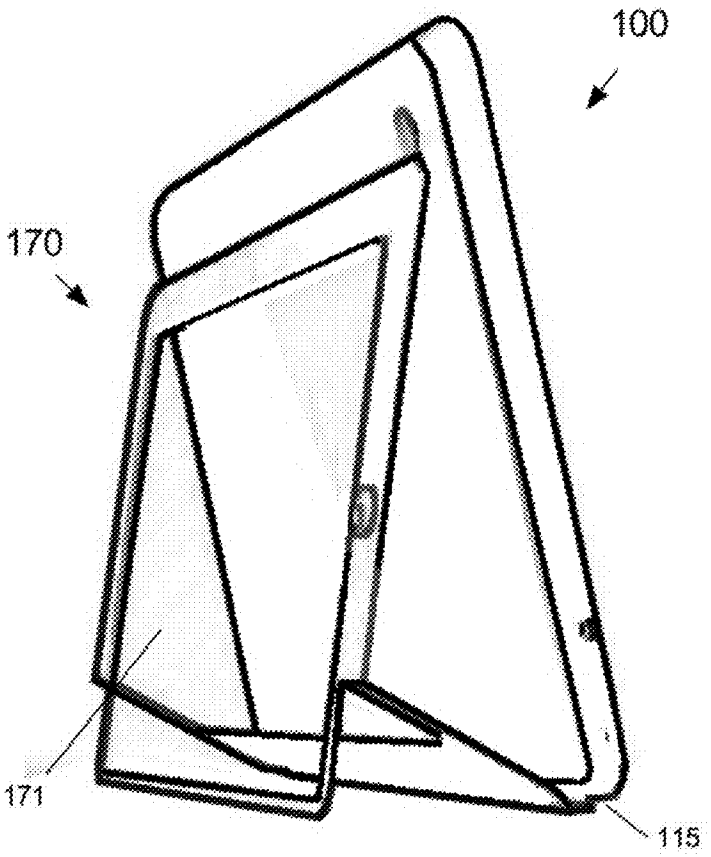
FIGS. 4A and 4B respectively depict front and back perspective views of an exemplary embodiment of a protective screen cover for an acoustic layer.
Figure 4A:
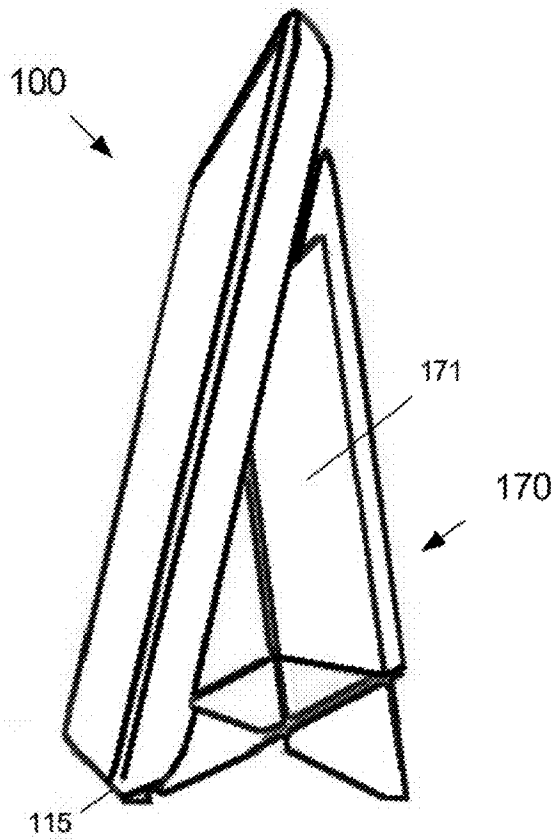

In an alternative exemplary embodiment, the integral protective screen cover is hinged at or near front edge 115. FIGS. 4A and 4B respectively depict front and back perspective views of an exemplary embodiment of a protective screen cover 170 for an acoustic layer that is hinged at or near front edge 115. In particular, protective screen cover 170 is shown in an open position, thereby supporting a pad-type device in a semi-vertical position. Protective screen cover 170 is coupled to acoustic layer 100 by a hinge (not shown) near the bottom end 115 of acoustic layer 100. Protective screen cover 170 comprises a screen 171 that permits the display of a pad-type device to be viewed when protective cover 170 is a closed position.

In one exemplary embodiment, acoustic layer device 100 includes a camera lens piece 113 that provides a lens function for a camera contained in a pad-type device. In another exemplary embodiment of acoustic layer device 100, camera lens piece 113 also provides a release mechanism to mechanically release a pad-type device from the acoustic layer device. For the lens function, camera lens piece 113 comprises a lens that allows light to pass from the bottom of the acoustic layer device to the lens of a camera of a pad-type device. For the release mechanism, lens piece 113 can be depressed from the bottom side of acoustic layer 100 by a user and a cylindrical member containing the lens moves toward the top of the acoustic layer device, thereby lifting a pad-type device contained in recessed-well region 102 and allowing a user to grip the edges of the pad-type device. It should be understood that the exemplary embodiment of camera lens piece 113 is merely an example and other embodiments are contemplated. In another exemplary embodiment, the camera lens piece 113 can be replaced by an aperture that provides a viewing port for the lens of a camera of a pad-type device.

FIGS. 2A and 2B respectively depict an internal top view and an internal top perspective view of the exemplary embodiment of acoustic layer device 100 depicted in FIGS. 1A-1G according to the subject matter disclosed herein. As depicted in FIGS. 2A and 2B, the bottom cover 107 of acoustic layer 100 comprises space 109 for an audio processing device 120, space 110*a*, 110*b* for each of two audio transducers 130*a*, 130*b* (of which only audio transducer 130*a* is shown in FIG. 2B), an audio enhancement acoustic waveguide structure 140, and space 111 for a power source 160 (not shown in FIG. 2A or 2B), such as a battery. It should be noted that FIG. 2A depicts bass output aperture 104, although base output aperture 104 is part of top cover 106.

Figure 3:
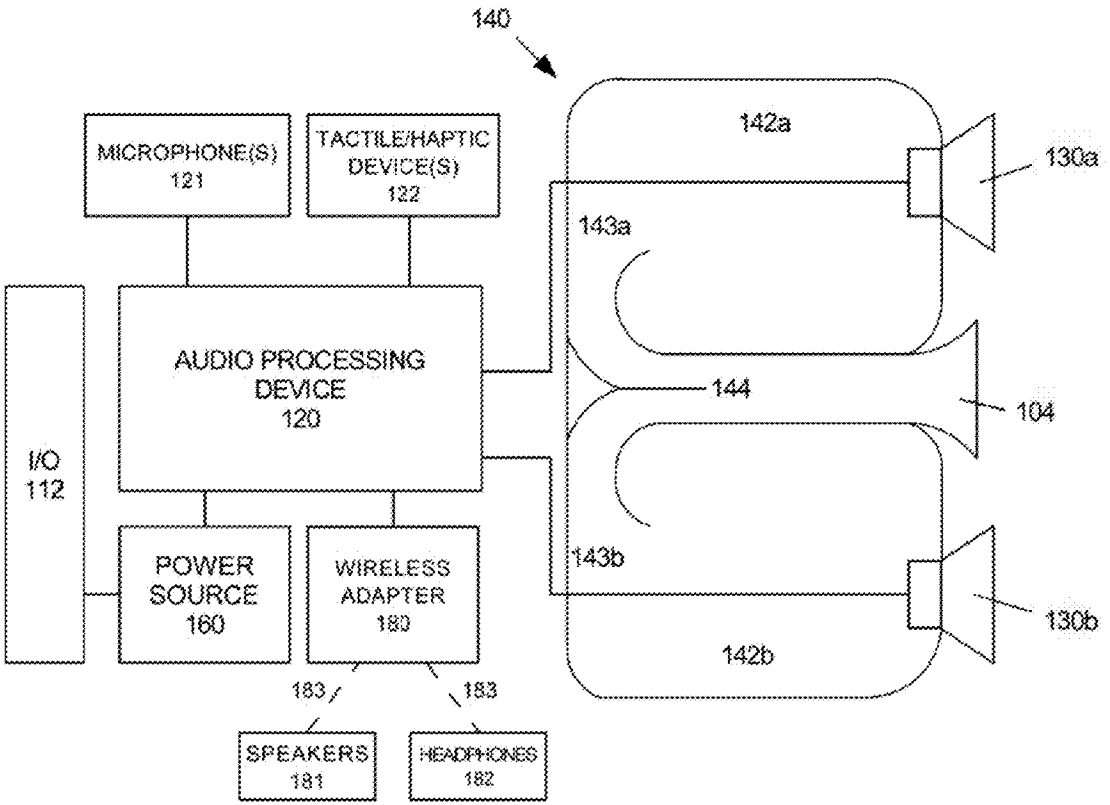
FIG. 3 depicts a functional block diagram of the exemplary embodiment of an acoustic layer according to the subject matter disclosed herein.

FIG. 3 depicts an exemplary functional block diagram of the exemplary embodiment of acoustic layer device 100. Audio signal processing device 120 receives an audio output signal from the pad-type device through, for example, I/O connector 112 (shown in FIGS. 1A, 1G and 2A) and provides audio-signal processing in a well-known manner, such as but not limited to amplification, and audio frequency response enhancement and reduction.

Audio signal processor device 120 is coupled to and drives audio transducers 130*a*, 130*b* in a well-known manner to generate an audio output that is projected from the front side of transducers 130*a*, 130*b*, and out through apertures 103*a*, 103*b*. The audio output that is generated from the back side of each transducer 130*a*, 130*b* is contained by the acoustic waveguide structure 140 and channeled through aperture 104.

Power source 160 is coupled to and provides power to audio processor device 120 in a well-known manner. In one exemplary embodiment, audio processing device 120 is coupled to an audio transducer, such as audio speakers 181 and/or headphones 182, through a wireless adapter 180 that provides an optical and/or a radio frequency (RF) link 183, such as, but not limited to, a Bluetooth-type link and/or a WiFi-type link, to audio speakers 181 and/or headphones 182. In another exemplary embodiment, the link between wireless adapter 180 and audio speakers 181 and/or headphones 182 is a bi-directional link. In still another exemplary embodiment, the link between wireless adapter 180 and headphones 182 is an output-directive link in which the output from the acoustic layer device is directed to headphones 182. In yet another exemplary embodiment, wireless adaptor 180 provides a bi-directional wireless link between acoustic layer 100 and an external device, such as but not limited to a data source and/or an Internet connection. It should also be understood that the spaces for the various functional components depicted in FIG. 2B are merely exemplary, and could be arranged differently and/or to include more or fewer functional components.

In one exemplary embodiment, acoustic waveguide structure 140 comprises walls 141 that are configured to form chambers 142*a*, 142*b*, a waveguide 143*a*, 143*b*, an acoustic waveguide mixing region 144, and an acoustic output channel 145, which is fluidly coupled to bass output aperture 104. Chambers 142*a*, 142*b* are configured so that a length L and a width W of the chamber enhances a bass response of the audio transducers. In one exemplary embodiment, walls 141 are joined to bottom portion 107 so that there is a smooth radius of curvature where wall 141 joins bottom portion 107 in order to minimize air turbulence and provide optimum and efficient audio enhancement. Acoustic waveguide mixing region 144 is configured to couple the respective audio signals from chambers 142*a*, 142*b*.

It should be understood that the exemplary configuration of acoustic waveguide structure 140 and the arrangement of audio processor device 120, transducers 130*a*, 130*b*, and power source 160 depicted in FIGS. 2A and 2B is merely one exemplary configuration. Other configurations are possible. In another exemplary embodiment, one or more additional acoustic waveguide structures could be included to enhance selected portions of the audio frequency band.

In one exemplary embodiment, the acoustic layer device according to the subject matter disclosed herein comprises a microphone 121 that detects audio signals that are then processed by, for example, audio processing device 120. In another exemplary embodiment, the acoustic layer device according to the subject matter disclosed herein comprises at least two microphones 121 configured in a spatial-diversity microphone arrangement that passes their respective signals through optional amplifiers (not shown) and then to digitizers that are part of for example, audio processor device 120. The digitized microphone signals are then digitally signal processed by, for example, a digital signal processor (DSP), to determine and extract speaker-positional information, and/or room acoustical details, such as but not limited to room reverberation, room echo, room noise, room acoustical delay, and room frequency response, thereby providing a directive sound enhancement and focusable directive sound capture ability.

Additionally, the extracted audio information can be used to enhance the intelligibility of an intentionally generated audio signal in a room, such as when the acoustic layer device is being used as a speaker phone. That is, the acoustic layer device can be configured to provide enhanced speakerphone capability by providing room de-reverberation, noise cancelling, equalization, and other possible features, such as but not limited to speaker identification or speaker positional information. In one exemplary embodiment, the acoustic layer device may also provide voice-recognition capabilities, thereby allowing transcription and/or voice-activated control of the functional aspects of the acoustic layer device, such as but not limited to volume, equalization, muting, or any aspect of the performance of the hardware, firmware, or an application running on the personal multi-media electronic device. Generally, digital signal processing can be added to further voice the acoustic layer output sound to change the equalization, spatialization (for example, stereo separation), phase linearization, or other acoustic properties of the delivered sound experience.

In one exemplary embodiment, muting effectuated by voice command, referred to herein as "smart-muting," only mutes the audio signal that is ultimately passed along to a listener at the other end of a conversation while still being capable of listening for and processing subsequent voice commands, such as but not limited to "unmute."

Figure 5:
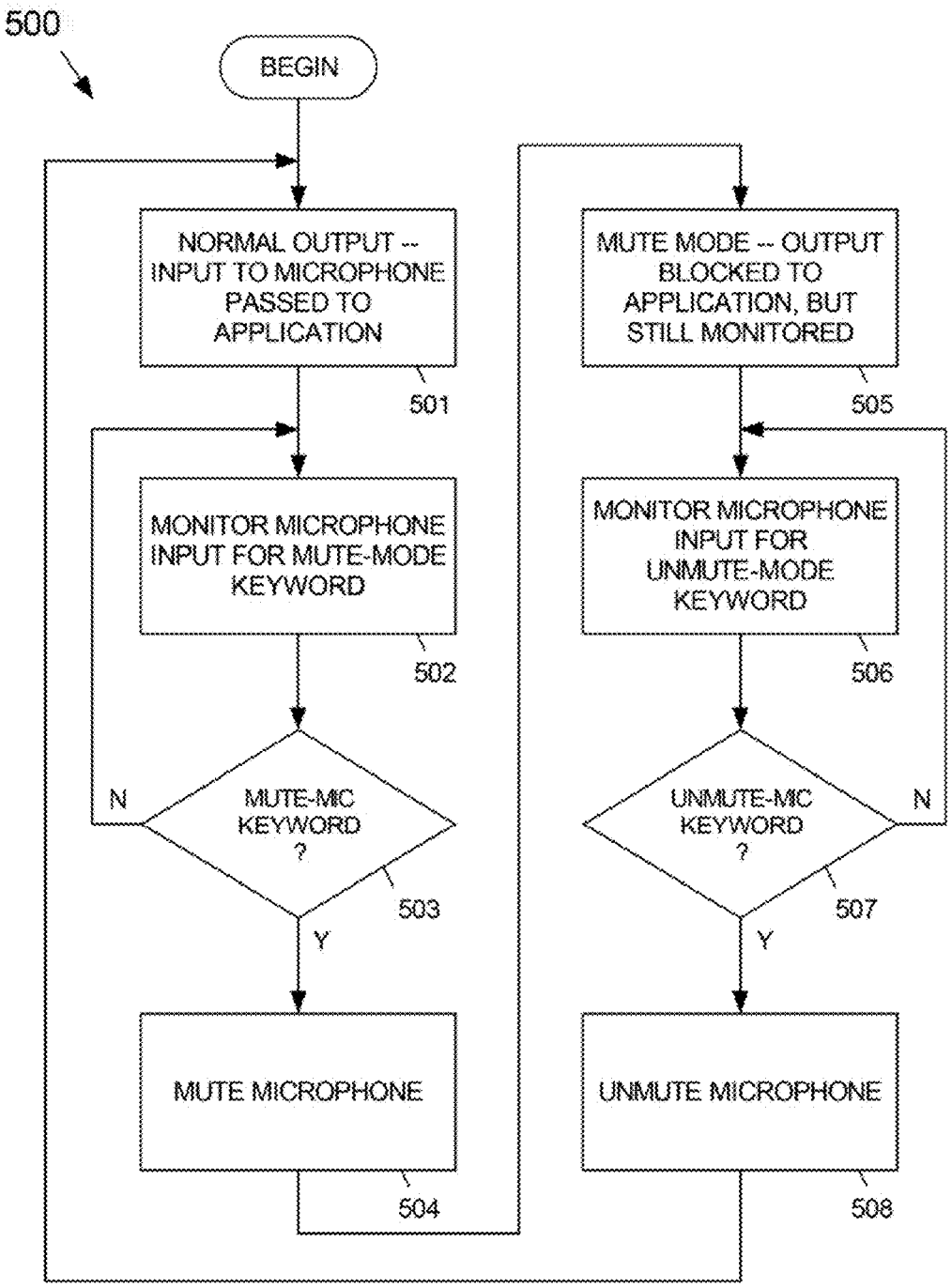
FIG. 5 depicts a flow diagram for one exemplary embodiment of a voice-actuated muting function provided by an acoustic layer according to the subject matter disclosed herein.

FIG. 5 depicts a flow diagram 500 for one exemplary embodiment of a voice-actuated muting function provided by acoustic layer device 100. Process flow begins at 501 where the microphone output is in a normal, unmuted mode and is passed to an application. At 502 and 503, the microphone input is monitored for a particular muting keyword that will place the acoustic layer device into a mode in which the output of the microphone is muted. If, at 503, it is determined that the muting keyword has been spoken, flow continues to 504 where the microphone output is muted from the application; otherwise, flow returns to 502 for continued monitoring for the particular muting keyword. From 504, flow continues to 505 where the output of the microphone is muted from the application. At 506 and 507, the microphone output is monitored for a particular unmuting keyword that will return the acoustic layer device to the normal, unmuted mode. If, at 507, it is determined that the unmuting keyword has been spoken, flow continues to 508 where the acoustic layer device returns to the normal, unmuted mode and 501; otherwise, flow returns to 506 for continued monitoring for the unmuting keyword.

Generally, microphones 121 configured in a spatial-diversity arrangement in conjunction with DSP can be used to improve the intelligibility of any intentionally generated user input or environmentally ambient sound that might be used by an application running on the acoustic layer device, the encased personal multi-media electronic device, or combinations thereof. A plurality of microphones configured in a spatial-diversity arrangement can also be used to record sound from the room and/or to calibrate room acoustics, thereby providing information to the DSP making it possible to provide specific equalization for enhancing a listening experience, such as but not limited to removing variations in a frequency response of a room and/or linearizing the phase of the acoustic signal delivered to a listener by removing unwanted sounds, such as ambient and/or background noise. In an exemplary embodiment, the spatial-diversity microphone configuration can be configured to provide a monaural modality.

In an exemplary embodiment, a portion of audio processing device 120 provides two-dimensional and/or three-dimensional tactile and/or haptic feedback 122 to a user such as, but not limited to, vibration that could be generated by, for example, one or more piezo-electric devices, electrostatic devices, magneto-static devices, and/or speaker motor or any other device that creates a physical motion in the case that can be sensed by a user as a vibration, impulse, or jerk. The vibration generated by a tactile/haptic portion 122 of audio processing device 120 could also provide haptic abilities for any soft button, hard button, control input, or on-screen touch of any sort, or combinations thereof. The vibration can also be used to enhance a user experience of an application, such as but not limited to a video game, movie, or audio.

Further, vibration can be used to alert a user to any aspect of the operation of either the personal media-media electronic device and/or the acoustic layer device, or even in response to some sound that the microphones have picked up either with or without DSP being applied. Vibration can be used in some way as part of an application itself. Examples might include but are not limited to massage, alarm-clock, or as a stimulus for some sort of measurement or trigger of additional hardware or of the environment.

In an exemplary embodiment, power source 160 (FIG. 3) of the acoustic layer device provides a battery monitoring and charging functionality that optimizes the operating time of both the acoustic layer device and a pad-type device. That is, the discharge/charge rates of the internal battery of the acoustic layer device, which powers the amplifier and associated acoustic layer device electronics, and the battery of the pad-type device, which plays content from an application running on the pad-type device, are balanced so that the battery operating time for the acoustic layer device and a pad-type device are substantially equal. According to one exemplary embodiment, power source 160 monitors the discharge levels of the acoustic layer device battery and the pad type device battery during respective discharge cycles, and accumulates data representative of a pair of discharge curves for the acoustic layer device batteries and the pad-type device batteries.

The battery discharging/charging technique used by the acoustic layer device monitors the current state of the respective batteries state-of-charge (SOC), and measures the rate of change of the energy of the batteries over time, and then uses this data to create two discharge curves predicting the end of playback for each device. The technique then charges either the battery of the acoustic layer device and/or the battery of the pad-type device so that discharge of the respective batteries occurs at substantially the same time. At the point in which charging of the batteries has compensated any initial discharge time differences to be substantially equal, both batteries are charged in the appropriate proportions to maintain equal playback time until both batteries are fully charged. In another exemplary embodiment, the battery discharge/charge functionality is provided by another component other than power source 160, such as, but not limited to, processing device 120.

While the description above pertains to use of the conceived acoustic layer device 100 with a pad-type device, the embodiments likewise include acoustic layer device embodiments configured and beneficially employed for enhancing the audio output performance of other devices, such as but not limited to laptop-type computing devices.

Figure 6:
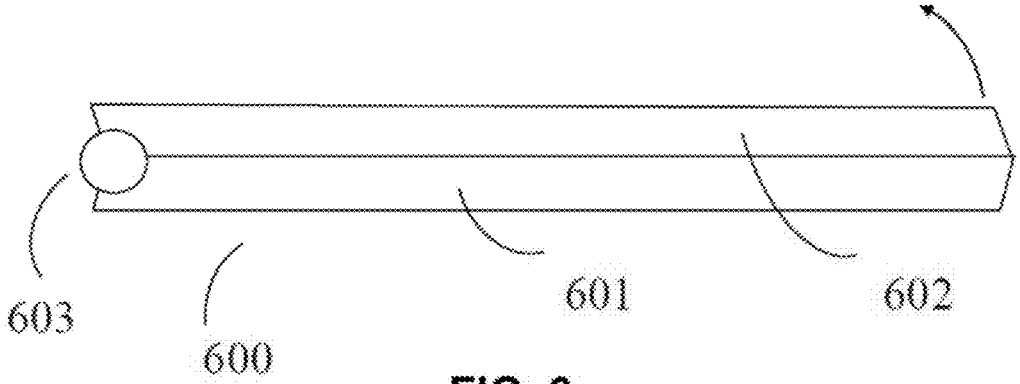
FIG. 6 depicts a common prior art laptop computer including a bottom keyboard layer, an upper display layer, and a hinge attaching the two layers.

FIG. 6 diagrammatically depicts a common prior art laptop-type computer 600. This structure includes a keyboard layer 601 that contains the user keyboard for inputting information to the computer. The keyboard layer often includes a touch pad, and typically also contains most of the computer's electronic components. The display layer 602 contains the computer display and also functions as the computer's lid. A hinge, 603 attaches the display layer to the keyboard layer and allows the display layer to open from and close upon the keyboard layer when the unit is not in use.

Figure 7:
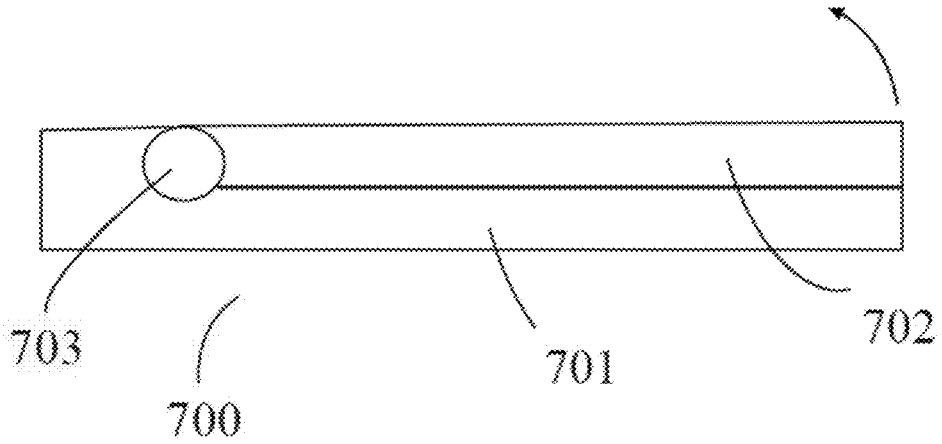
FIG. 7 depicts a prior art laptop computer including a bottom keyboard layer with an irregular shape, an upper display layer, and a hinge attaching the two layers.

FIG. 7 depicts another prior art laptop-type computer 700. This structure includes a keyboard layer 701 that exemplifies the use of an irregular shape (e.g., asymmetrical in cross-section). This keyboard layer likewise contains the user keyboard for inputting information to the computer, often includes a touch pad, and typically contains most of the computer's electronic components. The display layer 702 contains the computer display and also functions as the computer's lid. A hinge 703 attaches the display layer to the keyboard layer and allows the display layer to open from and close upon the keyboard layer when the unit is not in use.

Figure 8:
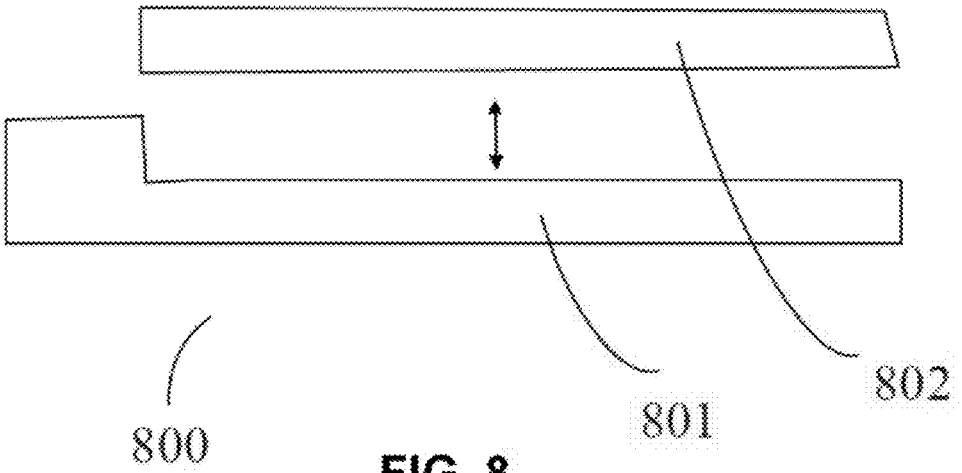
FIG. 8 depicts a prior art laptop computer including a bottom keyboard layer with an irregular shape, an upper display layer which can be detached from the keyboard layer entirely.

FIG. 8 depicts still another prior art laptop-type computer 800. This structure includes a keyboard layer 801 that exemplifies the use of an irregular shape. This keyboard layer likewise contains the user keyboard for inputting information to the computer, often includes a touch pad, and typically contains most of the computer's electronic components. The display layer 802 contains the computer display and also functions as the computer's lid.

Instead of using a hinge for attachment, the design shown in FIG. 8 joins the keyboard and display layers by some method that typically allows for the keyboard and display layers to be connected together for storage, and allows for the display layer to prop up against the keyboard layer for informally-connected operation (similar to the hinged case of FIG. 7, but not permanently attached). The connection methodology also allows for the display layer to be separated entirely from the keyboard layer.

An example of a structure similar to 800 exists when a tablet-device (such as an APPLE IPAD) in used in conjunction with a Bluetooth keyboard/case. In that example, most of the computer's electronic components are located in the display layer rather than the keyboard layer.

For each of the depicted existing laptop computer configurations 600, 700, and 800, the emphasis on compact size has led to a computer design that has dramatic restrictions on the quality of any acoustic performance that the computer will attempt to produce, because there is no intentional layer included to do a decent job of reproducing the sounds that the laptop may create while a user is enjoying, music, audio books, movies, video games and other applications with audio content.

Figure 9:
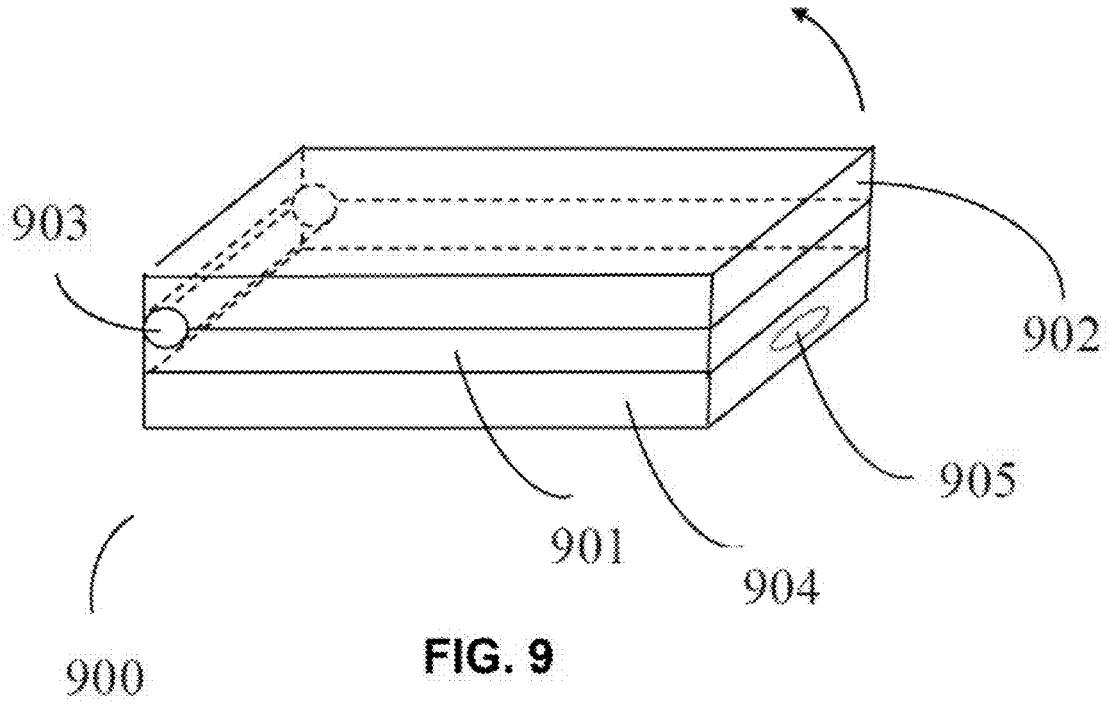
FIG. 9 depicts an exemplary laptop computer consisting of a bottom keyboard layer, an upper display layer, and a hinge attaching them, to which an acoustic layer has been added according to the subject matter disclosed herein.

FIG. 9 shows a key focus of this disclosure. In this case, laptop computer 900 consists of a keyboard layer (or 'keyboard portion') 901, a display layer (or 'display portion') 902, and a connection hinge 903. In addition to these previously-seen elements, this design includes the addition of an intentional acoustic layer 904. This acoustic layer adjoins one or more layers of the laptop-type computer to form an integrated unit that functions as a laptop computer with enhanced acoustic abilities. Also shown is an acoustic port 905 that provides an exit path for the back-wave of the speakers that are connected with the acoustic layer 904. The exit path for the front waves of the computer's LEFT and RIGHT speakers may be located on the acoustic layer 904, or may actually exit through one of the surfaces of the keyboard or display layers.

FIG. 9 shows this acoustic layer to be adjoined only to the keyboard layer. It is possible, however, to locate the acoustic layer in other places—such as between the keyboard layer 901 and the display layer 902. It is even possible to adjoin the acoustic layer to the non-display side of the display layer. Generally speaking, an acoustic layer can be coupled with either layer (keyboard or display) of the laptop-type device that includes one or more speakers, according to alternative embodiments.

The shape of the acoustic layer 901 shown in FIG. 9 is basically a regular shape. It is possible to design the shape of the acoustic layer to be any useful shape that a specific design might require. Not only is it possible for the shape of the acoustic layer to be irregular in a simple way, it is also possible for one or more of the surfaces of the acoustic layer to be highly detailed, such as conforming to spaces made available from one of the other layers. An example of this might include the acoustic layer occupying spaces made available from the variations in the size of components or sub-systems located in other layers (e.g. the keyboard layer or display layer).

The performance improvements that the inclusion of an intentional acoustic layer brings to the various multi-media functions of a laptop computer are many. Such improvements include but are not limited to much-higher audio power output, waveguide acoustic design to greatly enhance the bass response, advanced DSP functions such as equalization, increased LEFT/RIGHT channel separation, bass-enhancement algorithms, dynamic range algorithms (such as compression), and advanced support for speakerphone operation including such capabilities as spatial rendering of the physical location of various speakers in the room and de-reverberation of room acoustics. Some of these capabilities may be greatly improved through the inclusion of two microphones in the design.

While the features of the acoustic layer are described as including speaker drivers, power supplies, audio amplifiers, DSP, microphones, back-wave speaker ports, front-wave speaker ports, acoustic waveguide structure and various interconnect, it is not necessary that all of these constituents are physically located inside the confines of that acoustic layer. Some of these components may be integrated into other layers (e.g., the keyboard-layer or the display-layer) since it may be more economical to do so, or there may be improved performance in some aspect by doing so. What is important is that the inclusion of these acoustic-layer features to a normal laptop computer is a major improvement to the laptop computer. It is possible to create a laptop-type device that includes an acoustic layer, but which may be missing the hinge structure, and/or missing one of the other layers (e.g. keyboard layer or display layer). In such a case, the non-apparent layer is likely integrated into one of the other layers. An exemplary embodiment is a tablet computer that integrates the keyboard and display layer into a single integrated layer. It is possible to add an acoustic layer, as described in this disclosure, to such an integrated structure, or one without a hinge.

FIG. 9 shows an embodiment of an acoustic layer 904 for a laptop-type device according to the subject matter disclosed herein. Acoustic layer 904 provides a robust stereo audio output with an enhanced-bass for a laptop-type device while also providing a protective surface for the laptop-type device. Acoustic layer 904 encloses an audio processing device, such as an audio amplifier with functional controls, two audio transducers (i.e., speakers), an audio enhancement acoustic waveguide structure, and a power source. The audio processor device drives the audio transducers in a well-known manner to generate an audio output that is projected from the front side of the audio transducers and through apertures typically in the top of the laptop-type device, though such apertures could be located, in other positions such as on the front, side or back of any of the laptop device layers. These "layers" may or may not be independently observable as separate layers from the outside of the device, even though they will typically have internal separations (if not external ones.)

According to the subject matter disclosed herein, the audio output generated from the back side of each transducer is channeled through an acoustic waveguide structure adapted to enhance the bass response of the audio transducers. The output of the acoustic waveguide structure is through a bass output aperture 905. The acoustic waveguide structure provides a richer, fuller-sounding audio output in comparison to the audio output from only the front side of the audio transducers.

The internal structure and components of the acoustic layer 904 (FIG. 9) corresponds in most respects (and in some embodiments, identically) to that of the acoustic layer device 100. For example, it typically comprises space 109 (FIG. 2B) for an audio processing device 120, space 110*a*, 110*b* for each of two audio transducers 130*a*, 130*b* (of which only audio transducer 130*a* is shown in FIG. 2B), an audio enhancement acoustic waveguide structure 140, and space 111 for a power source 160 (not shown in FIG. 2A or 2B), such as a battery. It should be noted that FIG. 2A depicts bass output aperture 104, although base output aperture 104 is part of cover 106.

For the purpose of this disclosure, surface 102 in FIG. 1 may best be considered to be part of the internal boundary between the acoustic layer and one of the other layers of the laptop-type device, such as the keyboard layer. It is important that the acoustic layer be sealed to prevent air leakage, except for the presence of the acoustic port 905. If a passive radiator is used instead of an acoustic port, then the acoustic layer 904 would likely be completely sealed. If the acoustic layer shares its space with another layer (for example the keyboard layer), then that combined space (acoustic+keyboard layer) would need to be sealed to avoid air leaks except for the intentional acoustic port 905.

Acoustic port 104 is shown to be on the top surface of the recessed-well region 102, such as when the acoustic layer is the topmost surface of the laptop-type device in an embodiment. If the acoustic layer is an inner layer, the acoustic port 104 would more likely exit through one of the side surfaces, such as the front (depicted as 905 in FIG. 9.) One aspect of this disclosure is the recognition that the application of acoustic tuning of the speakers' back-wave acoustic space via sealing and waveguide construction are significant contributions to providing a functioning acoustic layer to the construction of a laptop-type device. In prior art, laptop computing devices always have essentially accidental treatment of the speakers back-wave acoustic signals.

Figure 10:
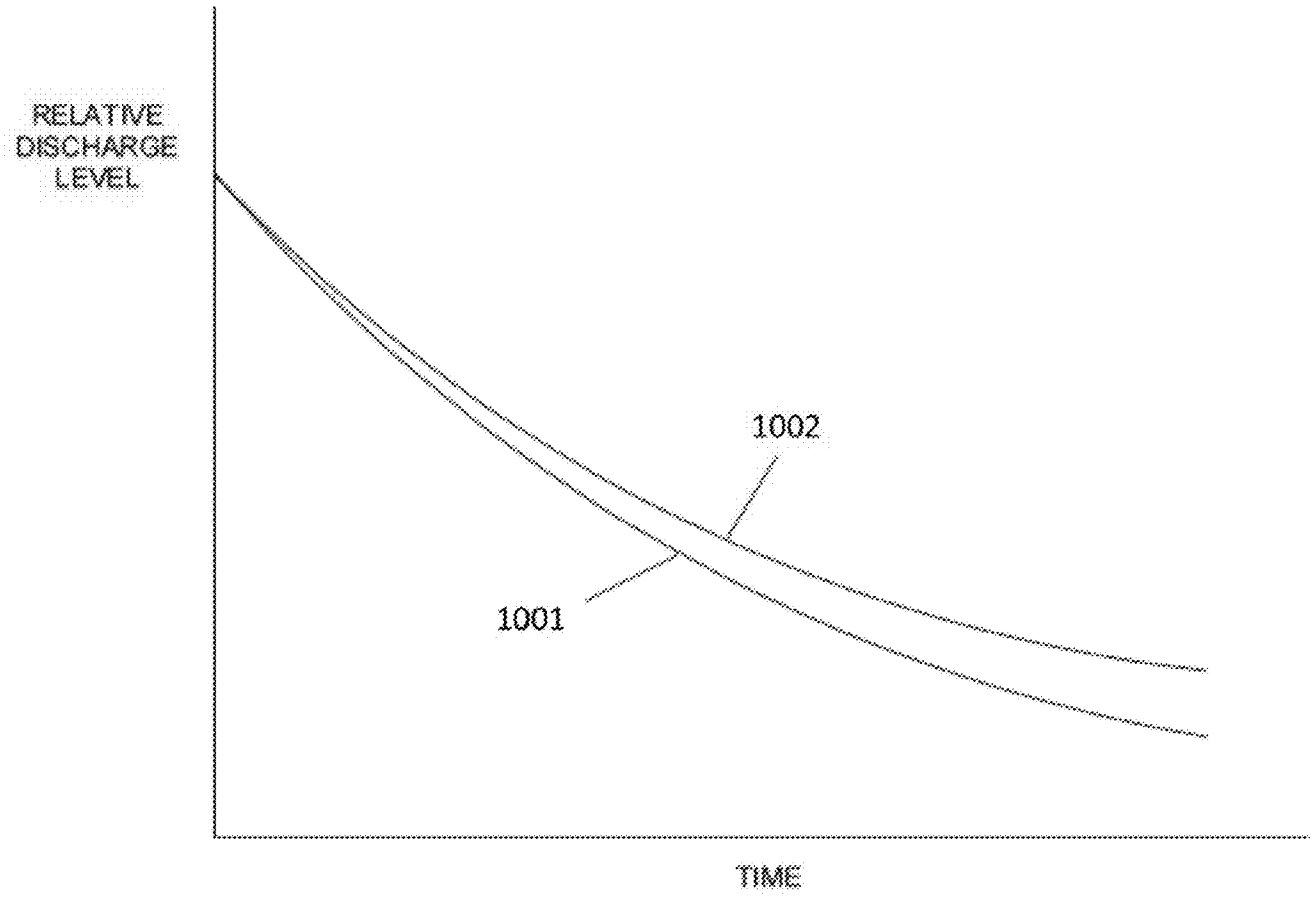
FIG. 10 depicts an exemplary relative discharge level for the battery of an acoustic layer device and an exemplary relative discharge level for the battery of a pad-type device as a function of time.
Figure 11:
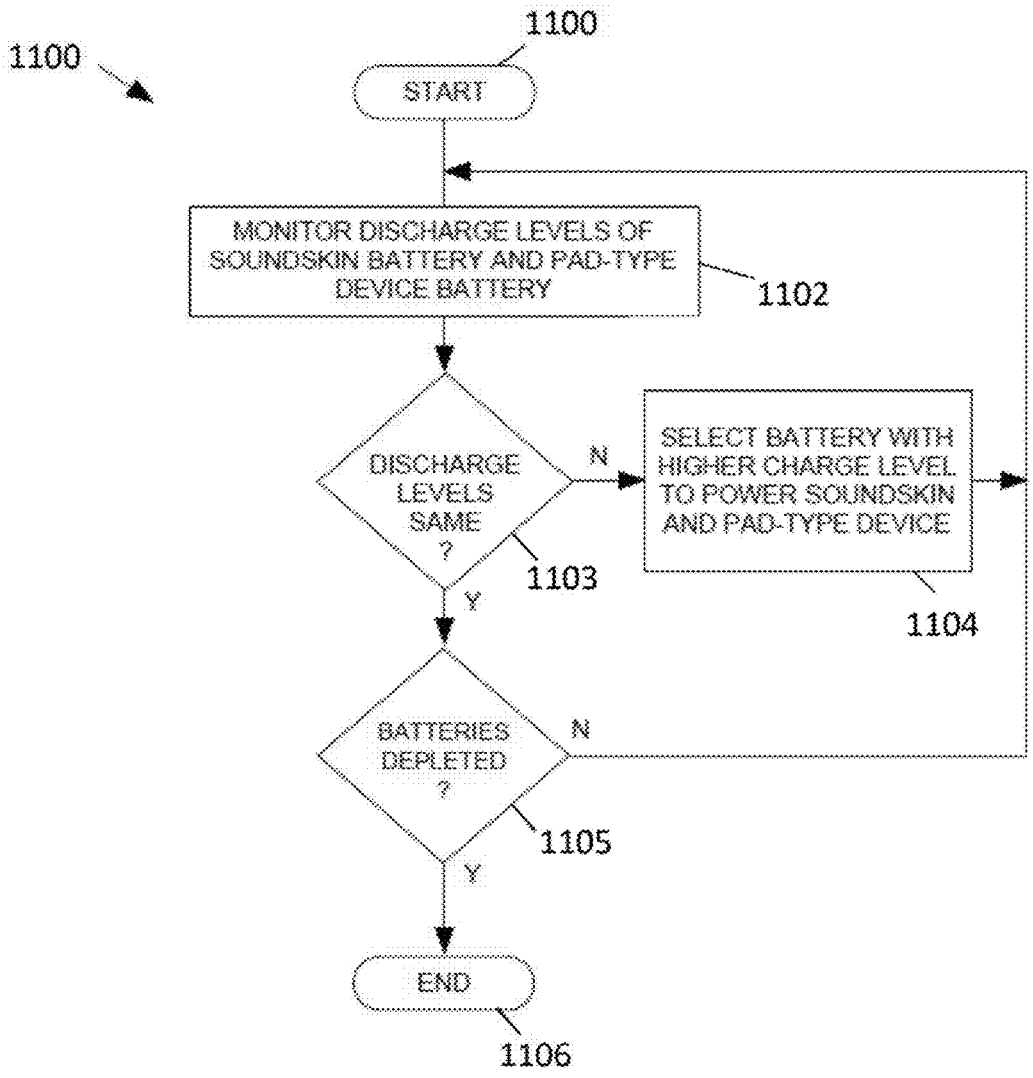
FIG. 11 depicts a flow diagram for a general exemplary process tier monitoring the discharge level of the battery of the acoustic layer device and the battery of a pad-type device according to the subject matter disclosed herein.
Figure 12:
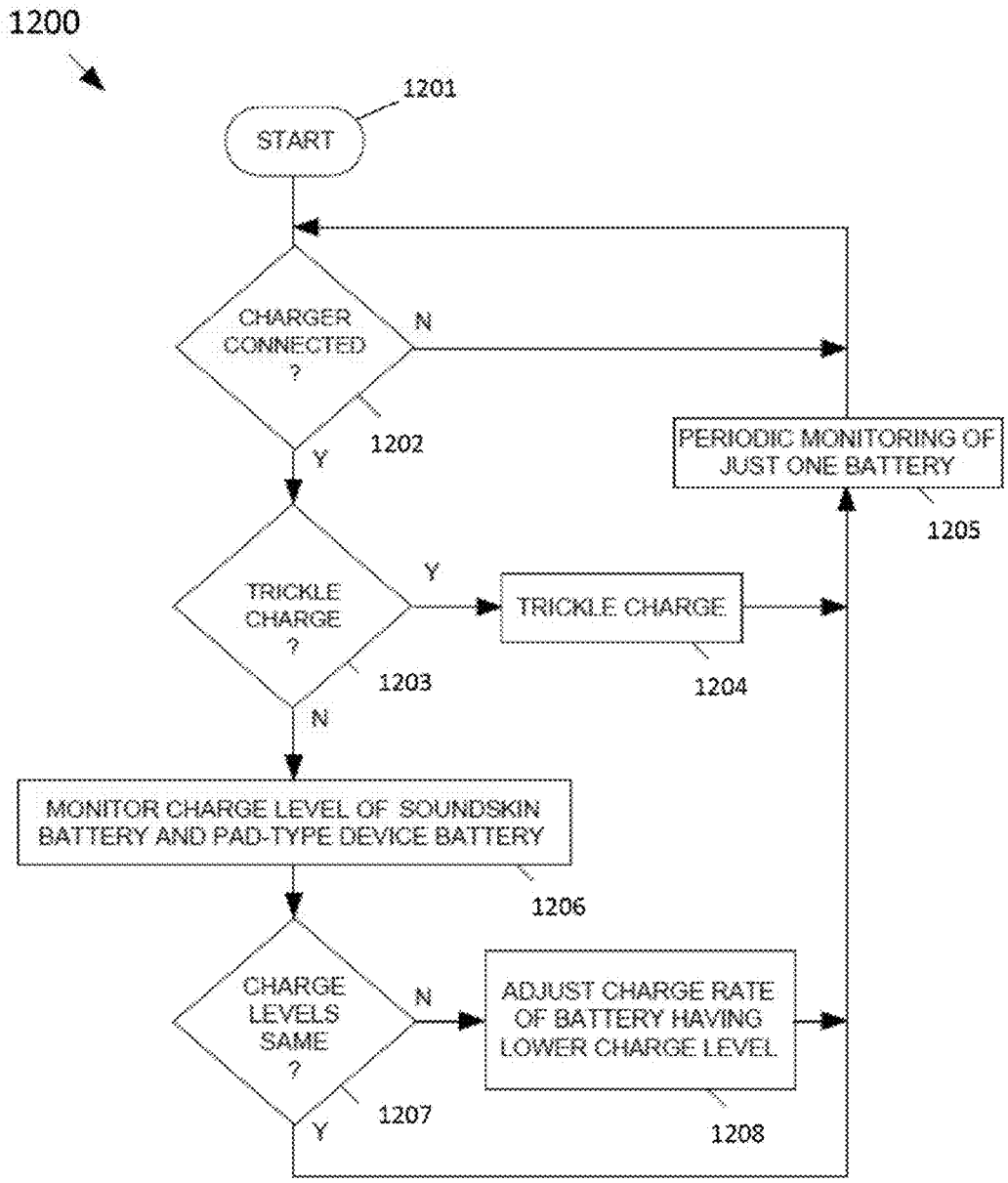
FIG. 12 depicts a flow diagram for a general exemplary process for charging the batteries of an acoustic layer device and of a pad-type device according to the subject matter disclosed herein.

FIG. 10 depicts an exemplary relative discharge level 1001 for the battery of an acoustic layer device, and an exemplary relative discharge level 1002 for the battery of a pad-type device, each as a function of time. FIG. 11 depicts a flow diagram for a general exemplary process 1100 for monitoring the discharge level of the battery of the acoustic layer device and the battery of a pad-type device. FIG. 12 depicts as flow diagram for a general exemplary process 1200 for charging the batteries of an acoustic layer device and of a pad-type device.

The process of monitoring the discharge levels of the batteries starts at 1101 of FIG. 11 when a pad-type device is inserted into an acoustic layer device and/or when the acoustic layer device and the pad-type device are powered on. The process flows to 1102 where power source 160 monitors the discharge level of the acoustic layer device battery and the discharge level of the pad-type device battery with respect to time. Information relating to the battery chemistry of the pad-type device can be manually selected by a user and/or sensed in a well-known manner by power source 160. As the discharge levels are monitored, it is determined at 1103 whether the discharge level of one battery is lower than the discharge level of the other battery.

If a difference in discharge levels is determined, flow continues to 1104 where power source 160 selects the battery having the higher charge level to power both the acoustic layer device and the pad-type device, to balance discharge levels of the batteries so that the battery operating time for the acoustic layer device and a pad-type device are substantially equal. Flow then continues from 1104 back to 1102. If, at 1103, no difference in discharge level is detected, flow continues to 1105 where it is determined whether the batteries have been depleted. If, at 1105, it is determined that the batteries have not been depleted, flow returns to 1102. If, at 1105, it is determined that the batteries have been depleted, flow continues to 1106 where the acoustic layer device shuts down both the acoustic layer device and the pad-type device.

Referring now to FIG. 12, the process of monitoring the charging levels of the batteries starts at 1201, and in one exemplary embodiment is an ongoing background process while the exemplary process depicted in FIG. 11 is performed. Flow continues to 1202 where it is determined whether a battery charger is connected to the acoustic layer device. If not, flow remains at 1202. If, at 1202, it is determined that a battery charger is connected to the acoustic layer device, flow continues to 1203 where it is determined whether a trickle charge is needed to charge the batteries. If so, flow continues to 1204 where a trickle charge of the acoustic layer device battery and the pad-type device battery is used. Flow continues to 1205 where periodically, such as about every 15 minutes, charge is applied to only one battery so that the charge level of the other battery is monitored to determine where it lies along its charge level curve (FIG. 10). Flow continues to 1202.

If, at 1203, it is determined that more than a trickle charge is needed to charge the batteries, flow continues to 1206 where power source 160 monitors the charge level of the battery of the acoustic layer device and the battery of the pad-type device. Flow continues to 1207 where it is determined whether there is a difference in charge level between the battery of the acoustic layer device and the battery of the pad-type device. If a difference in charge level is determined at 1207, flow continues to 1208 where the charge rate of each battery is adjusted so that the battery detected as having the lower charge level receives a higher rate of charge.

In one exemplary embodiment, the battery that is determined to be farther to the right (i.e., lower in charge) along the corresponding curve in FIG. 10 receives a higher charge rate. For example, the battery determined to have the lower charge level could receive a 75% greater charging rate that the battery determined to have the greater charge level. In another exemplary embodiment, the proportion allocated to the battery determined to have the lower charge level could be greater than or less than 75%. Regardless of the allocated charge rates, the battery that is determined to have the lower charge level receives a higher charge rate so that both batteries become fully charged at substantially the same time.

Flow continues from 1208 to 1205 where periodically, such as about every 15 minutes, charge is applied to only one battery so that the charge level of the other battery is monitored to determine where it lies along its charge level curve (FIG. 10). Flow continues to 1202.

If, at 1207, no difference in charge levels is detected, flow continues to 1205 where periodically, such as about every 15 minutes charge is applied to only one battery so that the charge level of the other battery is monitored to determine where it lies along its charge level curve (FIG. 10). Flow continues to 1202.

In one exemplary embodiment, the acoustic layer device comprises a keyboard (not shown) that is integral to the acoustic layer device. In another exemplary embodiment, the acoustic layer device comprises a keyboard (not shown) that is removably coupled to the acoustic layer device. In still another exemplary embodiment, the acoustic layer device comprises a keyboard (not shown) that is wirelessly coupled to the acoustic layer device, such as through an RF link and/or an infrared link.

Although the foregoing disclosed subject matter is described in some detail for purposes of clarity of understanding, it will be apparent to an ordinarily skilled artisan that certain changes and modifications may be practiced that are within the scope of the appended claims. Accordingly, the present embodiments are to be considered as illustrative and not restrictive, and the subject matter disclosed herein is not to be limited to the details given herein, but may be modified within the scope and equivalents of the appended claims.

We claim:

1. An acoustic layer device, comprising:

a housing adapted to couple with either or both of a keyboard portion and a display portion of a laptop-type computer;

at least one microphone disposed within the housing;

a signal processing device contained in the housing and capable of receiving a signal from the laptop-type computer when it is coupled with the housing, the signal processing device being coupled with the at least one microphone;

at least one audio transducer device coupled with the signal processing device, the at least one audio transducer device being configured to generate an audible audio output in response to an audio signal output from the signal processing device; and an acoustic waveguide coupled with the at least one audio transducer device and capable of receiving the audible audio output and generating an enhanced bass audio output from the acoustic waveguide;

wherein the housing further comprises:

a first space enclosed by the housing for each audio transducer, each first space being capable of receiving the corresponding audio transducer; and a first aperture for each audio transducer, each first aperture being configured to port the audio output from the corresponding audio transducer to a space external to the housing when the corresponding audio transducer is received in the first space for the audio transducer;

wherein the acoustic waveguide is coupled with each first space, the acoustic waveguide being configured to receive the audio output from a second side of the corresponding audio transducer when the corresponding audio transducer is received in the first space for the audio transducer, each acoustic waveguide comprising a length and a width that generates an enhanced audio output from the audio output from the second side of the corresponding audio transducer when the audio transducer is received in the first space for the audio transducer, each enhanced audio output having a bass frequency response that is greater than a base frequency response of the audio output from a first side of the corresponding audio transducer, wherein the acoustic waveguide further comprises:

an acoustic waveguide mixing region coupled with each acoustic waveguide, the acoustic waveguide mixing region capable of receiving and mixing together the enhanced audio output generated from each audio transducer; and a second aperture configured to port the mixed-together enhanced audio output to the space external to the housing when the two audio transducers are received in the corresponding first spaces.

2. The acoustic layer device of claim 1, wherein the at least one microphone is at least two microphones configured in a spatial-diversity arrangement.

3. The acoustic layer device of claim 2, wherein the signal processing device receives audio input signals from each of the at least two microphones and provides a directive sound enhancement of the audio input signals based on a room reverberation, a room echo, a room noise, a room acoustic delay, a room frequency response, speaker-positional information, or a combination thereof, that is determined by the signal processing device.

4. The acoustic layer device of claim 1, further comprising a tactile device, a haptic device, or a combination thereof, coupled with the signal processing device.

5. The acoustic layer device of claim 1, further comprising a wireless adaptor coupled with the signal processing device, the wireless adaptor providing a wireless link between the acoustic layer device and a device external to the acoustic layer device.

6. The acoustic layer device of claim 5, wherein the wireless link is a bi-directional wireless link.

7. The acoustic layer device of claim 5, wherein the external device is selected from the group consisting of an audio speaker, a pair of headphones, or a data source.

8. The acoustic layer device of claim 1, wherein the laptop-type computer is selected from the group consisting of a laptop computer, a netbook computer, an ultrabook computer, and a tablet computer.

9. The acoustic layer device of claim 1, further comprising a battery contained within the housing.

10. The acoustic layer device of claim 8, wherein the signal processing device is configured to control charging of a battery of the laptop-type computer when it is coupled with the housing.

11. An acoustic layer device, comprising:

a housing adapted to couple with a laptop-type computing device;

at least two microphones coupled with the housing;

a signal processing device disposed within the housing and capable of receiving a signal from the laptop-type device when it is coupled with the housing, the signal processing device being coupled with the at least two microphones, the signal processing device receiving audio input signals from each of the at least two microphones and providing to a laptop-type device a directive sound enhancement of the audio input signals based on a room reverberation, a room echo, a room noise, a room acoustic delay, a room frequency response, speaker-positional information, or a combination thereof, that is determined by the signal processing device;

at least one audio transducer device coupled with the signal processing device, the at least one audio transducer device capable of generating an audible audio output in response to an audio signal output from the signal processing device; and an acoustic waveguide coupled with the at least one audio transducer device and capable of receiving the audible audio output and generating an enhanced bass audio output from the acoustic waveguide, wherein the housing further comprises:

a first space enclosed by the housing for each audio transducer, each first space being capable of receiving the corresponding audio transducer; and a first aperture for each audio transducer, each first aperture being configured to port the audio output from the corresponding audio transducer to a space external to the housing when the corresponding audio transducer is received in the first space for the audio transducer;

wherein the acoustic waveguide is coupled with each first space, the acoustic waveguide being configured to receive the audio output from a second side of the corresponding audio transducer when the corresponding audio transducer is received in the first space for the audio transducer, each acoustic waveguide comprising a length and a width that generates an enhanced audio output from the audio output from the second side of the corresponding audio transducer when the audio transducer is received in the first space for the audio transducer, each enhanced audio output having a bass frequency response that is greater than a base frequency response of the audio output from a first side of the corresponding audio transducer, wherein the acoustic waveguide further comprises:

an acoustic waveguide mixing region coupled with each acoustic waveguide, the acoustic waveguide mixing region capable of receiving and mixing together the enhanced audio output generated from each audio transducer; and a second aperture configured to port the mixed-together enhanced audio output to the space external to the housing when the two audio transducers are received in the corresponding first spaces.

12. The acoustic layer device of claim 11, further comprising a tactile device, a haptic device, or a combination thereof, coupled with the signal processing device.

13. The acoustic layer device of claim 11, further comprising a wireless adaptor coupled with the signal processing device, the wireless adaptor providing a wireless link between the acoustic layer system and a device external to the acoustic layer system.

14. The acoustic layer device of claim 13, wherein the wireless link is a bi-directional wireless link.

15. The acoustic layer device of claim 13, wherein the external device is selected from the group consisting of an audio speaker, a pair of headphones, or a data source.

16. The acoustic layer device of claim 11, wherein the laptop-type device is selected from the group consisting of a laptop computer, a netbook computer, an ultrabook computer, and a tablet computer.

17. An acoustic layer device, comprising:

a housing adapted to layer with and externally to either or both of a keyboard portion and a display portion of a laptop-type computer;

a signal processing device contained in the housing and capable of receiving a signal from the laptop-type computer when it is layered with the housing;

at least one audio transducer device coupled with the signal processing device, the at least one audio transducer device being configured to generate an audible audio output in response to an audio signal output from the signal processing device; and an acoustic waveguide coupled with the at least one audio transducer device and being configured to receive the audible audio output and generate an enhanced bass audio output from the acoustic waveguide;

wherein the housing further comprises a first space enclosed by the housing for each audio transducer, each first space being configured to receive a corresponding audio transducer; and wherein the acoustic waveguide is coupled with each first space, the acoustic waveguide being configured to receive the audible audio output from a second side of the corresponding audio transducer when the corresponding audio transducer is received in the first space for the audio transducer, each acoustic waveguide being configured to generate the enhanced bass audio output from the audible audio output from the second side of the corresponding audio transducer when the audio transducer is received in the first space for the audio transducer, each enhanced bass audio output having a bass frequency response that is greater than a base frequency response of the audio output from a first side of the corresponding audio transducer.

18. The acoustic layer device of claim 17, wherein the housing further comprises a first aperture for each audio transducer, each first aperture being configured to port the audio output from the corresponding audio transducer to a space external to the housing when the corresponding audio transducer is received in the first space for the audio transducer.

19. The acoustic layer device of claim 17, wherein the acoustic waveguide further comprises an acoustic waveguide mixing region coupled with each acoustic waveguide, the acoustic waveguide mixing region being configured to receive and mix together the enhanced audio output generated from each audio transducer.

20. The acoustic layer device of claim 19, wherein the acoustic waveguide further comprises a second aperture configured to port the mixed-together enhanced audio output to the space external to the housing when the two audio transducers are received in the corresponding first spaces.

21. An acoustic layer device, comprising:

a housing adapted to layer with and externally to a laptop-type computing device;

at least two microphones coupled with the housing;

a signal processing device disposed within the housing and capable of receiving a signal from the laptop-type device when it is layered with the housing, the signal processing device being coupled with the at least two microphones, the signal processing device receiving audio input signals from each of the at least two microphones and providing to a laptop-type device a directive sound enhancement of the audio input signals based on a room reverberation, a room echo, a room noise, a room acoustic delay, a room frequency response, speaker-positional information, or a combination thereof, that is determined by the signal processing device;

at least one audio transducer device coupled with the signal processing device, the at least one audio transducer device being configured to generate an audible audio output in response to an audio signal output from the signal processing device; and an acoustic waveguide coupled with the at least one audio transducer device and configured to receive the audible audio output and generate an enhanced bass audio output from the acoustic waveguide;

wherein the housing further comprises a first space enclosed by the housing for each audio transducer, each first space being capable of receiving the corresponding audio transducer; and wherein the acoustic waveguide is coupled with each first space, the acoustic waveguide being configured to receive the audio output from a second side of the corresponding audio transducer when the corresponding audio transducer is received in the first space for the audio transducer, each acoustic waveguide comprising a length and a width that generates an enhanced audio output from the audio output from the second side of the corresponding audio transducer when the audio transducer is received in the first space for the audio transducer, each enhanced audio output having a bass frequency response that is greater than a base frequency response of the audio output from a first side of the corresponding audio transducer.

22. The acoustic layer device of claim 21, wherein the housing further comprises a first aperture for each audio transducer, each first aperture being configured to port the audio output from the corresponding audio transducer to a space external to the housing when the corresponding audio transducer is received in the first space for the audio transducer.

23. The acoustic layer device of claim 21, wherein the acoustic waveguide further comprises an acoustic waveguide mixing region coupled with each acoustic waveguide, the acoustic waveguide mixing region capable of receiving and mixing together the enhanced audio output generated from each audio transducer.

24. The acoustic layer device of claim 23, wherein the acoustic waveguide further comprises a second aperture configured to port the mixed-together enhanced audio output to the space external to the housing when the two audio transducers are received in the corresponding first spaces.

* * * * *